United States Patent [19]

DeVaughn

[11] Patent Number: 4,542,833

[45] Date of Patent: Sep. 24, 1985

[54] STRETCHABLE CAP FOR SEALING AND/OR RESEALING BLOOD DRAWING TUBES AND THE LIKE

[75] Inventor: Donald H. DeVaughn, San Francisco, Calif.

[73] Assignee: Bio-Plas, Inc., San Francisco, Calif.

[21] Appl. No.: 619,348

[22] Filed: Jun. 11, 1984

[51] Int. Cl.[4] ..... B65D 41/22

[52] U.S. Cl. ..... 215/319; 215/341; 215/DIG. 1

[58] Field of Search ..... 215/DIG. 1, 341, 317, 215/353, 319

[56] References Cited

U.S. PATENT DOCUMENTS

| | | | |
|---|---|---|---|
| 1,986,741 | 1/1935 | Moser | 215/353 X |
| 3,005,564 | 10/1961 | Weichselbaum | 215/353 |
| 3,133,656 | 5/1964 | Foster | 215/317 |
| 3,441,162 | 4/1969 | Julius | 215/353 X |

FOREIGN PATENT DOCUMENTS

| | | | |
|---|---|---|---|
| 1236076 | 6/1960 | France | 215/317 |
| 1241271 | 8/1960 | France | 215/317 |
| 359960 | 6/1938 | Italy | 215/DIG. 1 |
| 1205887 | 9/1970 | United Kingdom | 215/341 |

*Primary Examiner*—Donald F. Norton

*Attorney, Agent, or Firm*—Flehr, Hohbach, Test, Albritton, Herbert

[57] ABSTRACT

A cap for sealing closed the opened end of an elongated tube such as a blood drawing tube, a test tube or the like is disclosed herein and comprises an integrally formed main body constructed of a flexible material, preferably polyethylene plastic. This main body is closed at its top end, and tapers outwardly at and near its bottom end, and it includes an arrangement of annular sealing ribs, all of which allow a cap to be readily positioned over the tube to be sealed in a reliable fluid sealed fashion and readily removed from the tube without causing the substance in the tube to aerosol (in the case of liquids) or otherwise escape into the ambient surroundings.

18 Claims, 3 Drawing Figures

STRETCHABLE CAP FOR SEALING AND/OR RESEALING BLOOD DRAWING TUBES AND THE LIKE

Figure 1:
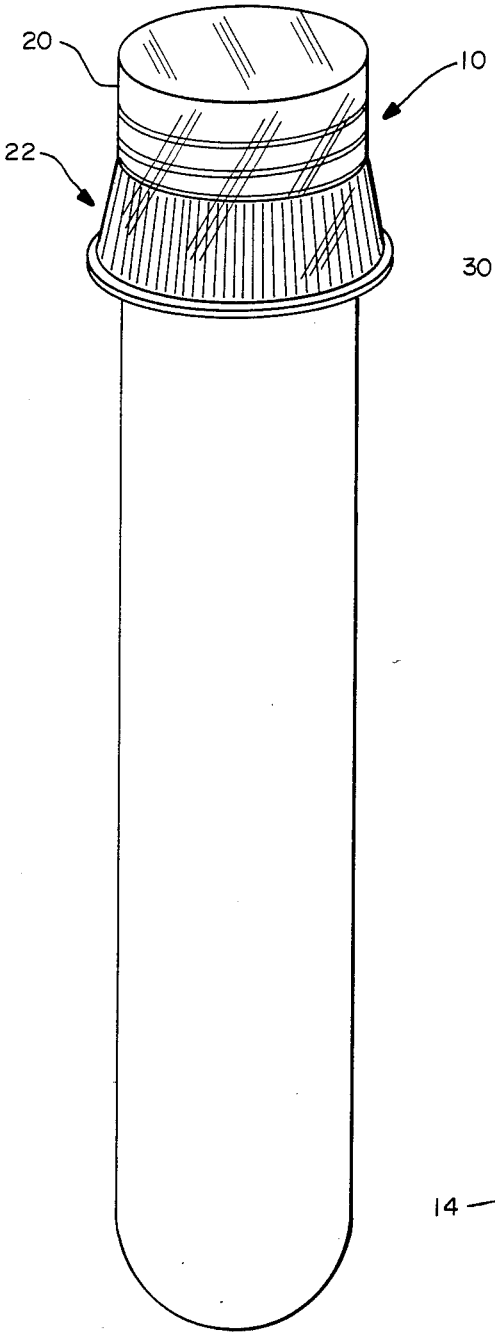

The present invention relates generally to means for sealing containers and more particularly to a cap or closure for sealing closed the opened end of an elongated tube such as a blood drawing tube, test tube or the like.

In the field of medical science with specific regard to laboratory technology, it is often necessary to seal and reseal blood drawing tubes, test tubes, culture tubes and the like, as rapidly as possible in some cases. For example, the technologist who is taking blood from a patient and filling a number of different blood drawing tubes typically does so in vacuum tubes through vacuum caps. These caps must be removed for processing of the samples collected and the tubes must then be recapped. Sometimes the technologists try to recap the tubes by replacing the original oversized stopper and find it difficult and time consuming. Moreover, these original stoppers sometimes tend to work their way out of the tubes due to internal pressure, thereby contaminating the surrounding work area including possibly the technologist with the substances within, for example infectious micro-organisms, while at the same time exposing these substances to contaminants in the ambient surroundings. The technologist is especially vulnerable when removing the stopper if the substance (a liquid) aerosols, which could happen if the technologist is not careful.

A substitute for the original stopper is parafilm. However, it is quite time consuming to cut parafilm into usable sizes (over 1 inch square) and it is quite costly to purchase individual usable squares of this material. Moreover, it is desirable to color code the closures used and this is not practical using parafilm.

In view of the foregoing, it is an object of the present invention to provide a cap or closure for sealing closed the opened end of an elongated tube such as a blood drawing tube, a test tube, a culture tube or the like, and particularly a cap or closure which eliminates many of the drawbacks of original stoppers and parafilm.

A more particular object of the present invention is to provide a cap or closure which may be readily placed over the opened end of a cooperating tube in reliable fluid sealing engagement therewith by technologists using only one hand.

Another particular object of the present invention is to provide a cap or closure which can be easily removed from a cooperating tube by a technologist using only one hand.

Still another particular object of the present invention is to provide a cap or closure which, in the case of a tube containing a liquid, can be readily removed from that tube by a technologist using one hand only without causing the liquid contained within the tube to aerosol as the cap or closure is initially removed.

A further particular object of the present invention is to provide a cap or closure having a specific tube sealing arrangement which not only provides for a reliable seal but also (1) prevents the cap or closure from riding up and over the top end of the ube (in the case of glass tubes having radially outwardly projecting lips) and (2) takes into account all tubes which are out-of-round.

Still a further object of the present invention is to provide a cap or closure which is readily stretchable so as to fit with tubes of different sizes.

As will be seen hereinafter, the cap or closure described herein is integrally formed to include a closed top end, a circumferential sidewall depending down from the top end so as to define a receiving area for the top end section of a tube intended to be sealed by the cap. This sidewall includes at least a lowermost circumferential section which tapers outwardly in a downward direction whereby to define a downwardly opening circumferential space around the outer surface of the tube when the tube is disposed within the receiving area. This circumferential space accommodates the thumb or thumb nail of the technologist in order to allow him to readily remove the cap from the tube. The cap also includes as an integrally formed component an annular rib concentrically disposed around the inner surface of the sidewall a fixed distance from its top end and extending a fixed distance into the receiving area. The cap is sized relative to the tube and integrally formed from a sufficiently flexible material so as to receive readily the top end section of the tube within the receiving area such that this annular rib engages the entire outer annular circumference of the tube's top end section just under its upper lip in a fluid tight manner and such that the cap is equally readily removable from the top end section of the tube. In a preferred embodiment, the cap has a pair of additional annular ribs disposed below the first-mentioned one. These latter ribs extend radially further into the receiving area than does the first rib so as to accommodate tubes which are out-of-round to a limited extent. At the same time, these two lower ribs cooperate with one another so as to define therebetween an annular pocket such that the two ribs together with the pocket function as a suction device around the outer circumference of the tube, thereby providing enhanced sealing capabilities. In this same preferred embodiment, the overall cap is constructed of particular stretchable (elastic) polyethylene plastic.

Figure 2:
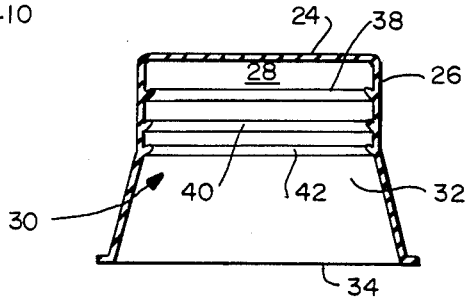
Figure 3:
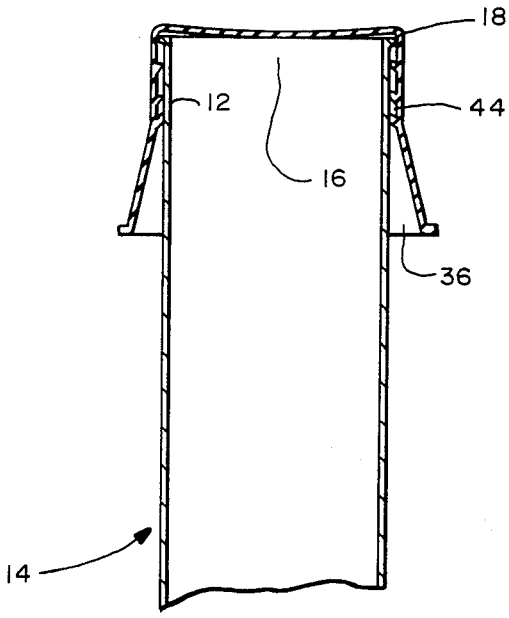

The cap just discussed briefly will be described in more detail hereinafter in conjunction with the drawing wherein: FIG. 1 is a perspective view of a cap located over a cooperating tube; FIG. 2 is a cross-sectional view of the cap of FIG. 1, apart from the tube; and FIG. 3 is a cross-sectional view of the cap of FIG. 1 shown in sealing engagement over the top opened end of the tube of FIG. 1.

Turning to the drawing, wherein like components are designated by like reference numerals throughout the three figures, a cap or closure designed in accordance with the present invention is illustrated and generally designated by the reference numeral 10. This cap is shown in FIGS. 1 and 3 in sealing engagement over the opened top end section 12 of an elongated tube 14 such as a blood drawing tube, a test tube, a culture tube or the like. The particular tube illustrated is a glass tube having a top opened end 16 including an uppermost annular lip 18 which projects radially outwardly beyond the outermost surface of the rest of the tube, as seen in FIG. 3.

Cap 10 is integrally formed as a single unit from a flexible or stretchable material, preferably polyethylene. For purposes of description, the cap may be divided into two sections, a top end section 20 and a bottom frustum shaped skirt 22. The top end section includes a closed top end 24 and a cylindrical sidewall 26 depending down from the top end so as to define a receiving area 28 for top end section 12 of tube 14. Top end section 20 of cap 10 also includes an arrangement 30 of sealing ribs which will discussed in more detail hereinafter. As best illustrated in FIG. 2, skirt 22 has a top opened end 32 and a larger bottom opened end 34 that depends down from cylindrical sidewall 26 in coaxial relationship with the latter. In this way, when the top end section 12 of tube 14 is placed within receiving area 28 of the cap's top end section, as will be discussed in more detail below, the skirt defines a downwardly opening circumferential space 36 around the outer surface of tube 14, as best illustrated in FIG. 3. The reason for this circumferential space will be explained below. The skirt also has an outer circumferential band of downwardly extending grooves 29 which provides added friction to the cap when the latter is handled.

As stated above, the top section 20 of cap 10 includes an arrangement 30 of sealing ribs. In the particular embodiment illustrated and in a preferred embodiment, this arrangement consists of three vertically spaced annular sealing ribs concentrically disposed around the inner surface of sidewall 26 fixed distances from top end 24. The uppermonst one of these ribs which is indicated at 38 in FIG. 2 projects a first fixed distance into receiving area 28 and the two lower ribs which are indicated at 40 and 42 project a second greater distance into the receiving area. The overall cap is sized relative to tube 14 and sufficiently flexible so as to receive readily the top end section 12 of the tube within receiving area 28 such that the uppermost rib 38 engages the entire outer annular circumference of the tube's top end section just under its upper lip 18 in a fluid tight manner. At the same time, the lower ribs 40 and 42 which project further into receiving area 28 also sealingly engage the outer circumference of the tube in the same manner as the uppermost rib. However, because these lower ribs project into the receiving area a greater distance than the upper rib, they will accommodate a limited amount of out-of-roundness in the tube. That is, even if the tube is out-of-round to a limited extent, the two lower ribs 40 and 42 will sealingly engage the outer circumference of the tube in a fluid tight fashion whereas the upper rib 38 might not since it does not extend as far into receiving area 28.

The three ribs 38, 40 and 42 not only serve individually as surface contact seals around the top end section 12 of tube 14, but the uppermost rib cooperates with outwardly projecting lip 14 (in the case of tube 14) in order to prevent the entire cap from riding up over the lip and off the top end of the tube. At the same time, the two lower ribs 40 and 42 define therebetween an annular pocket 44 (see FIG. 3) and together with this pocket function as a suction device around the outer circumference of the tube in order to provide enhanced sealing capabilities. In this regard, the two ribs 40 and 42 must be positioned sufficiently close to one another to provide pocket 44 and must be sufficiently flexible so as to provide the suction just mentioned. Howver, this can be readily provided by those with ordinary skill in the art in view of the teachings herein.

In order for the ribs 38, 40 and 42 to provide reliable seals around tube 14, it should be apparent that they must project sufficient distances into receiving area 28. However, at the same time, if they project too far into the receiving area, it may be difficult to get the cap onto the tube or, more than likely, it might be difficult to remove the cap. As indicated above, the two lower ribs 40 and 42 extend further into the receiving area than rib 38 in order to compensate for tube out-of-roundness. At the same time, the ribs 40 and 42 are closer to skirt 22 and bottom opened end 36 and therefore can be stretched radially outward a greater distance than the rib 38. As a result, even though these lower two ribs extend further into the receiving area than the upper rib, this makes it no more difficult to remove the cap from the tube.

With particular regard to removing cap 10 from tube 14, reference is made specifically to FIG. 3 which shows the cap in its sealed position over the top end section 12 of the tube. Note the annular space 36 between the tube and the skirt 22. This space accomodates the thumb or thumb nail of the technologist in order to aid him in removing the cap. More specifically, by placing his thumb or thumb nail within this space on one side of the tube, the technologist can flip the cap off the top of the tube with one hand. As long as this is done slowly, one edge of the opened end 16 of the tube is opened to the ambient surroundings while the cap is still mostly in its initial closed position. This allows any gases within the tube to escape without resulting in any appreciable turbulence therein and, in the case of liquids within the tube, it allows the gases to escape without causing the liquids to aerosol. In addition, it allows the vacuum between ribs 42 and 44 to be broken easily for eliminating the suction provided by these ribs and thereby making it easier to remove the cap.

While overall cap 10 has been described including two specific sections, the upper section 20 which is cylindrical in outermost configuration and the lowermost frustum shaped skirt 22, it is to be understood that the upper sidewall 26 could taper in line with skirt 22 rather than being cylindrical in shape as shown. It is also to be understood that the thickness of the cap will in part determine its stretchability (along with the material selected to make up the cap, for example polyethylene). The cap should be sufficiently thick to provide structural integrity. On the other hand, it should be sufficiently thin to provide the desired stretchability in order to be properly sealed over the tube and readily removed therefrom, preferably by means of a technologist using one hand only. In an actual working embodiment, the cap is constructed of polyethylene, as stated above, and its top end 24, sidewall 26 and skirt 22 have wall thicknesses of approximately 0.020 inch, 0.015 inch and 0.033 inch, respectively. A given cap can be properly fitted around various sized tubes which vary in outer diameter as much as 0.070". Also, in a preferred embodiment, the caps come in various colors in order to color code the tubes.

What is claimed:

1. A cap for sealing closed the opened end of an elongated tube such as a blood drawing tube having an upper lip around its opened end, a test tube or the like, comprising:

(a) an integrally formed top end section having a closed top end, a cylindrical sidewall depending down from said top end so as to define a receiving area for a top end section of said elongated tube including the tube's upper lip, and an annular rib concentrically disposed around the inner surface of said sidewall a fixed distance from said top end and extending a fixed distance into said receiving area, said main section sized relative to said tube and integrally formed from a sufficiently flexible material so as to receive readily said top end section of said tube within said receiving area such that said annular rib engages the entire outer annular circumference of the tube's top end section just under its upper lip in a fluid tight manner and such that said main section is equally readily removable from said top end section of said tube;

(b) an outwardly tapering skirt having a cylindrical cross section, integrally formed of the same material as said upper main section and having a top opened end and a larger bottom opened end, said skirt being integrally connected at its top end to the bottom end of said cylindrical sidewall and extending down from the latter in coaxial relationship therewith whereby to define a downwardly opening circumferential space around the outer surface of said tube when the top end section of said tube is disposed within the receiving area of said top end section; and (c) said top end section including a second annular rib concentrically disposed around the inner surface of said sidewall below said first-mentioned rib and extending into said receiving area a fixed distance whereby to sealingly engage the outer circumference of said tube in the same manner as said first-mentioned rib, said second rib extending a greater distance into said receiving area than said first-mentioned rib whereby to compensate for a tube which might be out-of-round to a limited extent, said second rib being sufficiently closer in proximity to said skirt than said first-mentioned rib so as to flex radially outwardly to a greater extent than the first-mentioned rib.

2. A cap according to claim 1 wherein said top end section includes a third annular rib concentrically disposed around the inner surface of said sidewall below said second rib and extending into said receiving area a fixed distance whereby to sealingly engage the outer circumference of said tube in the same manner as said first-mentioned rib, said third rib extending a greater distance into said receiving area than said first-mentioned rib whereby to compensate for a tube which might be out-of-round to a limited extent, said second rib being sufficiently closer in proximity to said skirt than said first-mentioned rib so as to flex radially outwardly to a greater extent than the first-mentioned rib.

3. A cap according to claim 2 wherein said second and third ribs define therebetween an annular pocket and together with said pocket function as a suction device around the outer circumference of said tube.

4. A cap according to claim 3 wherein said top end section, skirt and ribs are constructed of a stretchable polyethylene plastic.

5. A cap for sealing closed the opened end of an elongated tube such as a blood drawing tube having a lip extending around its opened end, a test tube or the like, comprising an integrally formed main body having (i) a closed top end, (ii) a circumferential sidewall depending down from said top end so as to define a receiving area for a top end section of said elongated tube including the tube's lip, said sidewall including at least a lowermost circumferential section which tapers outwardly in the downward direction whereby to define a downwardly opening circumferential space around the outer surface of the tube when the top end section of the tube is disposed within said receiving area, and (iii) first, second and third vertically spaced annular ribs concentrically disposed around the inner surface of said sidewall fixed distances from said top end, said first rib being disposed above the second and third ribs and extending a first fixed distance into said receiving area and said second and third ribs extending a second greater fixed distance into said receiving area, said main body being sized relative to said tube and integrally formed from a sufficiently flexible material so as to receive readily said top end section of said tube within said receiving area such that said first rib engages the entire outer annular circumference of the tube's top end section just under its upper lip in a fluid tight manner and said second and third ribs sealingly engage the outer circumference of said tube in the same manner as said first rib even though the outer circumference of siadd tube engaged by said second and third ribs may be out-of-round to a limited extent and such that said main body is equally readily removable from said top end section of said tube.

6. A cap according to claim 5 wherein said second and third ribs define therebetween an annular pocket and together with said pocket function as a suction device around the outer circumference of said tube.

7. A cap according to claim 5 wherein said sidewall includes a cylindrical section above said lowermost tapering section.

8. A cap according to claim 5 wherein said main body is constructed of a stretchable polyethylene plastic.

9. A tube assembly, comprising:

(a) an elongated tube such as a blood drawing tube, test tube or the like having an opened top end having a lip extending around its opened end and a cylindrical tube body; and (b) a cap for sealing closed the opened end of said tube, said cap including an integrally formed main body having (i) a closed top end, (ii) a circumferential sidewall depending down from said top end so as to define a receiving area into which a top end section of said elongated tube including the tube's upper lip is disposed, said sidewall including at least a downwardly circumferential section which tapers outwardly in the downward direction whereby to define a downwardly opening circumferential space around the outer surface of the tube whereby to accomodate a user's thumbnail in removing said cap from said tube in a way which prevents aerosoling of any liquid substances with the tube, and (iii) first, second and third vertically spaced annular ribs concentrically disposed around the inner surface of said sidewall fixed distances from said top end, said first rib being disposed above the second and third ribs and extending a first fixed distance into said receiving area so as to engage the entire outer annular circumference of the tube's top end section just under its upper lip in a fluid tight manner and said second and third ribs extending a greater fixed distance into said receiving area so as to sealingly engage the outer circumference of said tube in the same manner as said first rib, even though the outer circumference of said tube engaged by said second and third ribs may be out-of-round to a limited extent, said main body being sized relative to said tube and integrally formed of a sufficiently flexible material so as to easily fit on and be removed from said tube.

10. A tube assembly according to claim 9 wherein the upper lip of said tube extends outwardly radially along its entire annular circumference, said lip cooperating with said first rib so as to prevent the cap from moving up the tube and over its top end.

11. A tube assembly according to claim 9 wherein said second and third ribs define therebetween an annular pocket and together with said pocket function as a suction device around said inner surface of said sidewall.

12. A cap for sealing closed the opened end of an elongated tube such as a blood drawing tube, a test tube or the like, comprising an integrally formed main body having (i) a closed top end, (ii) a circumferential side wall depending down from said top end so as to define a receiving area for a top end section of said elongated tube, and (iii) first and second vertically spaced annular ribs concentrically disposed around the inner surface of said side wall fixed distances from said top end, said first rib being disposed above the second rib and extending a first fixed distance into said receiving area and said second rib extending a second greater fixed distance into said receiving area, said main body being sized relative to said tube and integrally formed from a sufficiently flexible material so as to receive readily said top end section of said tube within said receiving area such that said first rib engages the entire outer annular circumference of the tubes' top end section just under its opened end in a fluid tight manner, such that said second rib sealingly engages the outer circumference of said tube in the same manner as said first rib even though the outer circumference of said tube engaged by said second rib may be out-of-round, to a limited extent, and such that said main body is readily removable from said top end section of said tube.

13. A cap according to claim 12 wherein said integrally formed main body includes a third annular rib concentrically disposed around the inner surface of said side wall directly below said second rib and extending into said receiving area the same fixed distance as said second rib.

14. A cap according to claim 13 wherein said second and third ribs define therebetween an annular pocket and together with said pocket function as a suction device around the outer circumference of said tube.

15. A cap according to claim 12 wherein said cylindrical side wall includes an upper cylindrical section including said ribs and defining said receiving area.

16. A cap according to claim 12 wherein said circumferential side wall has at least a circumferential section including the lowermost end of the side wall tapering outwardly in the downward direction whereby to define a downwardly opening circumferential space around the outer surfacee of said tube when the top end section of said tube is disposed within the receiving area defined by said side wall.

17. A cap according to claim 12 wherein said circumferential side wall includes cylindrical section including said ribs and defining said receiving area and a lowermost section which is disposed below said ribs and which tapers outwardly in the downward direction whereby to define a downwardly opening circumferential space around the outer surface of said tube when the top end section of said tube is disposed within the receiving area of said upper cylindrical section.

18. A cap according to claim 12 wherein said integrally formed main body includes a third annular rib concentrically disposed around the inner surface of said side wall directly below said second rib and extending into said receiving area the same fixed distance as said second rib, said second ribs defining therebetween an annular pocket and together with said pocket functioning as a suction devise around the outer circumference of said tube, and wherein said circumferential side wall includes an upper cylindrical section including said ribs and defining said receiving area and a lowermost section which is disposed below said ribs and which tapers outwardly in the downward direction whereby to define a downwardly opening circumferential space around the outer surface of said tube when the top end section of said tube is disposed within the receiving area of said upper cylindrical section.

* * * * *